US010933650B2

(12) United States Patent
Mashima

(10) Patent No.: US 10,933,650 B2
(45) Date of Patent: Mar. 2, 2021

(54) LIQUID SUPPLYING APPARATUSES, LIQUID EJECTING APPARATUSES, AND CONTAINERS

(71) Applicant: SEIKO EPSON CORPORATION, Tokyo (JP)

(72) Inventor: Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/922,421

(22) Filed: Mar. 15, 2018

(65) Prior Publication Data

US 2018/0272737 A1 Sep. 27, 2018

(30) Foreign Application Priority Data

Mar. 24, 2017 (JP) ..... JP2017-059259

(51) Int. Cl.
*B41J 2/175* (2006.01)
*B43L 25/00* (2006.01)
*B65D 5/40* (2006.01)

(52) U.S. Cl.
CPC ..... *B41J 2/17596* (2013.01); *B41J 2/1752* (2013.01); *B41J 2/17509* (2013.01); *B41J 2/17513* (2013.01); *B41J 2/17566* (2013.01); *B43L 25/005* (2013.01); *B43L 25/007* (2013.01); *B65D 5/40* (2013.01); *B41J 2002/17516* (2013.01)

(58) Field of Classification Search
CPC .. B41J 2/17596; B41J 2/17509; B41J 2/1752; B41J 2/17513; B41J 2/17566; B41J 2002/17516; B65D 5/40; B43L 25/007; B43L 25/005
See application file for complete search history.

(56) References Cited

U.S. PATENT DOCUMENTS 103,540 A * 5/1870 Armstrong ..... F16M 11/10 248/133
150,082 A * 4/1874 Reif ..... F16M 11/10 248/133
533,687 A * 2/1895 Walker ..... B67D 1/0891 248/133
692,434 A * 2/1902 Elliott ..... B65G 65/24 248/140
711,705 A * 10/1902 Keen et al. ..... F16M 11/10 248/133
1,595,329 A * 8/1926 Wheatley ..... B67D 3/0083 248/140

(Continued)

FOREIGN PATENT DOCUMENTS

CN 105313477 2/2016
JP 2011-519795 A 7/2011

*Primary Examiner* — Vishal Pancholi
*Assistant Examiner* — B Z
(74) *Attorney, Agent, or Firm* — Workman Nydegger

(57) ABSTRACT

A liquid supplying apparatus includes a support table on which a container for storing liquid can be placed, a liquid flow path detachably connected to the container, a movable section configured to push up the container placed on the support table. A force of the movable section pushing up the container is smaller than a weight of the container at full capacity. As the residual amount of liquid decreases, the container placed on the support table is pushed up by the movable section and displaced while remaining connected to the liquid flow path.

7 Claims, 3 Drawing Sheets

(56) References Cited

U.S. PATENT DOCUMENTS

| | | | | |
|---|---|---|---|---|
| 4,907,723 | A * | 3/1990 | Katz | B67D 3/00 222/105 |
| 5,275,313 | A * | 1/1994 | Petrillo | B67D 7/0288 222/377 |
| 6,386,393 | B1 * | 5/2002 | Paulovich | B67D 3/0029 211/80 |
| 6,554,164 | B1 * | 4/2003 | Jones | B65D 77/068 222/105 |
| 8,313,007 | B2 * | 11/2012 | Kpabar | B67D 3/0009 220/592.18 |
| 8,800,814 | B2 * | 8/2014 | Braun | B67D 3/0009 222/105 |
| 9,346,281 | B2 | 5/2016 | Okuno et al. | |
| 2007/0194264 | A1 * | 8/2007 | Arov | F16K 1/14 251/298 |
| 2007/0284389 | A1 * | 12/2007 | Jacobs | B65D 9/04 222/1 |
| 2009/0120956 | A1 * | 5/2009 | De La Fe Dahlin | B67D 1/0001 222/95 |
| 2011/0056983 | A1 | 3/2011 | Hackleman et al. | |
| 2012/0305595 | A1 * | 12/2012 | Braun | B67D 3/0009 222/105 |
| 2015/0239725 | A1 * | 8/2015 | Watts | B67D 3/0025 222/1 |
| 2016/0001567 | A1 | 1/2016 | Okuno et al. | |
| 2016/0263601 | A1 * | 9/2016 | Micnerski | B67D 1/0004 |
| 2017/0050764 | A1 * | 2/2017 | Caul, III | F16B 47/00 |
| 2018/0272737 | A1 * | 9/2018 | Mashima | B41J 2/17509 |

* cited by examiner

LIQUID SUPPLYING APPARATUSES, LIQUID EJECTING APPARATUSES, AND CONTAINERS

BACKGROUND

1. Technical Field

The present invention relates to liquid ejecting apparatuses such as printers, liquid supplying apparatuses configured to supply liquid such as ink, and containers configured to store liquid such as ink.

2. Related Art

Examples of the container for storing liquid such as ink include a container of a cardboard box that houses a liquid containing bag provided with a spout. JP-T-2011-519795 is an example of related art.

The residual amount of the liquid in the liquid containing bag cannot be visually observed since the bag is in the cardboard box.

SUMMARY

An advantage of some aspects of the invention is that a liquid supplying apparatus, a liquid ejecting apparatus, and a container configured such that a decrease of the liquid contained in the container can be visually recognized can be provided.

A liquid ejecting apparatus for solving the above problem includes a support table on which a container for storing liquid can be placed, a liquid flow path detachably connected to the container, and a movable section configured to push up the container placed on the support table, wherein a force of the movable section pushing up the container is smaller than a weight of the container at full capacity, and, as the residual amount of liquid decreases, the container placed on the support table is pushed up by the movable section and displaced while remaining connected to the liquid flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus, liquid supplying apparatus, and a container will be described. The liquid ejecting apparatus is, for example, an ink jet printer that performs printing by ejecting ink which is an example of the liquid onto a medium such as a paper sheet. The liquid supplying apparatus is an apparatus configured to supply liquid to the liquid ejecting apparatus.

Figure 1:
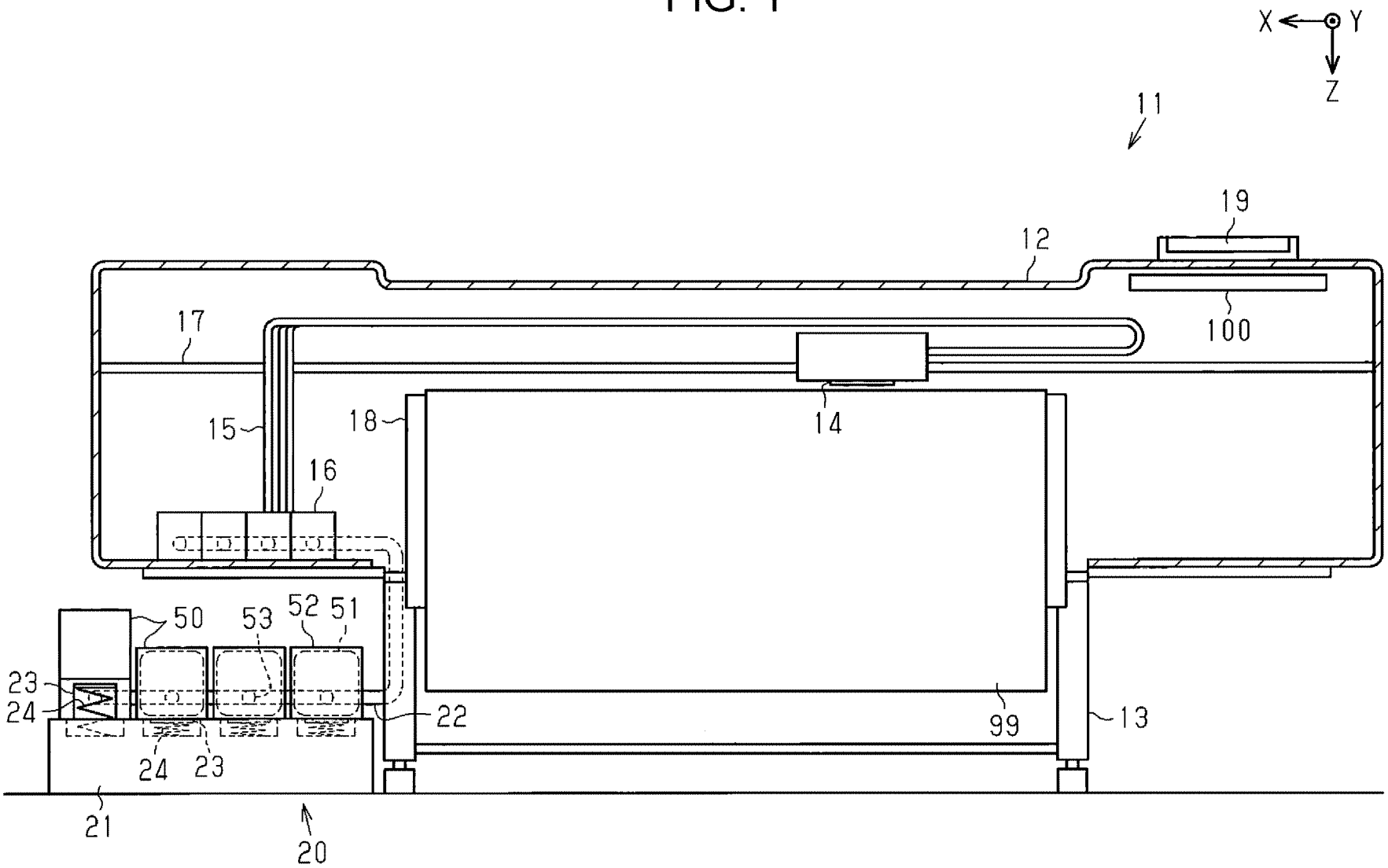
FIG. 1 is an overall configuration view which illustrates an embodiment of a container, a liquid supplying apparatus, and a liquid ejecting apparatus.

As shown in FIG. 1, a liquid ejecting apparatus 11 includes a housing 12, legs 13 that support the housing 12, a liquid ejection section 14, a supplying tube 15 that supplies liquid to the liquid ejection section 14, a supply pump 16 connected at a middle of the supplying tube 15, and a liquid supplying apparatus 20. The liquid ejection section 14 and the supply pump 16 are housed in the housing 12. The housing 12 is provided with an operation panel 19 through which an operation instruction can be inputted or on which an operational state is displayed.

The liquid ejection section 14 is configured to eject liquid onto a medium 99 while reciprocating in a direction X and the opposite direction. The medium 99, which has received the liquid, is transported in a direction Y to the outside the housing 12, and is then hung in a gravitational direction Z. The direction X, the direction Y, and the gravitational direction Z form a three-axis system.

The liquid ejecting apparatus 11 includes a guide shaft 17 that guides movement of the liquid ejection section 14, a medium support section 18 that can supports the medium 99, and a control unit 100, which are housed in the housing 12. The control unit 100 controls components of the liquid ejecting apparatus 11 including the liquid ejection section 14. The medium support section 18 can support the medium 99 outputted outside the housing 12 when an end portion of the medium support section 18 extends outside the housing 12.

The liquid supplying apparatus 20 includes a support table 21 on which a container 50 for storing liquid can be placed, a liquid flow path 22 detachably connected to the container 50, a movable section 23 configured to push up the container 50 placed on the support table 21, and a bias member 24 configured to bias the movable section 23 upward. The support table 21 preferably has a size that allows a plurality of containers 50 to be placed thereon. The plurality of containers 50 store, for example, different colors of ink, and liquid flow paths 22 are individually connected to each of the containers 50. The liquid flow path 22 is preferably configured with a tube that can be flexibly displaced.

An upstream end of the liquid flow path 22 is detachably connected to the container 50. A downstream end of the liquid flow path 22 is detachably connected to the upstream end of the supplying tube 15. The liquid flow path 22 may also be a single flow path that is connected to the supplying tube 15. The liquid flow path 22 and the supplying tube 15 are preferably connected to each other via the supply pump 16.

Figure 2:
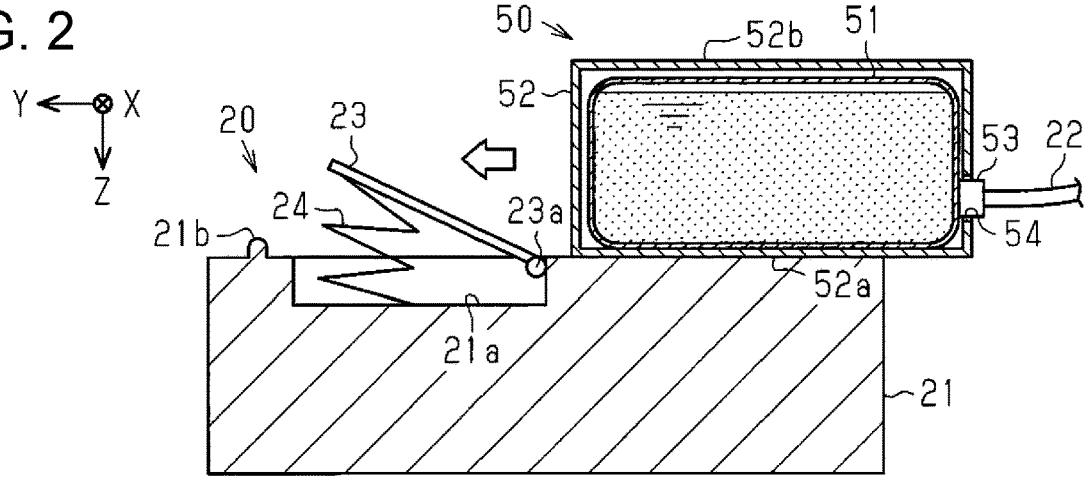
FIG. 2 is a cross-sectional view which illustrates a configuration of the container and the liquid supplying apparatus of FIG. 1.

As shown in FIG. 2, the movable section 23 is, for example, a plate that is pivotal about a pivot axis 23*a* which is provided at the proximal end of the movable section 23. The movable section 23 and the bias member 24 are preferably housed in a recess 21*a* formed on the support table 21. The bias member 24 is made of, for example, an elastic member and preferably located at a position where it biases the distal end of the movable section 23 vertically upward. The elastic member is, for example, an extendable spring. The bias member 24 may also be provided as magnets that are repelled from each other.

The support table 21 may have a protrusion 21*b* that can lock the container 50. In this case, the container 50, which is placed on the support table 21, may be moved toward the protrusion 21*b* (in the direction indicated by the white arrow in FIG. 2). When the container 50 comes onto the movable section 23, it abuts and is stopped by the protrusion 21*b*. Thus, the position where the container 50 abuts and is stopped by the protrusion 21*b* (the position shown in FIG. 3) is referred to as a set position.

Figure 3:
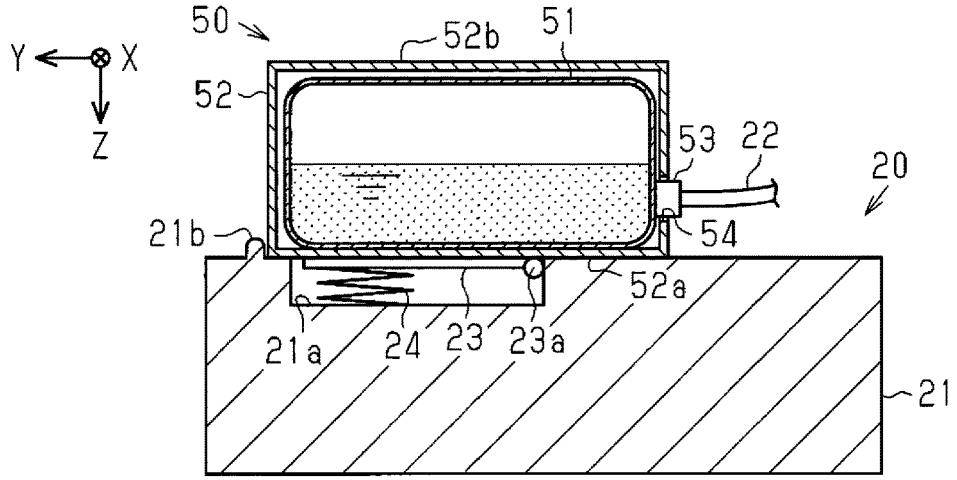
FIG. 3 is a cross-sectional view which illustrates that the container of FIG. 2 is set in the liquid supplying apparatus.

At the set position, the movable section 23 is disposed under the container 50 as shown in FIG. 3. The container 50 has a bottom 52*a* which is in contact with the movable section 23 when it is placed on the support table 21, and a top 52*b* which becomes an upper surface of the container 50 when it is located at the set position. The bias member 24 is preferably disposed under the movable section 23 so that the movable section 23 pushes the bottom 52*a* at the position spaced from a gravitational center position, which is a position at which the gravitational center of the container 50 is projected onto the bottom 52*a* when the container 50 is at the set position.

The force of the movable section 23 pushing up the container 50 at the set position, that is, a biasing force of the bias member 24 is preferably smaller than the weight of the container 50 at full capacity. In this case, when the container 50 at full residual capacity or almost full residual capacity is placed at the set position, the bias member 24 is compressed by the weight of the container 50 so that the movable section 23 and the bias member 24 are housed in the recess 21*a*. The biasing force of the bias member 24 may be equal to or larger than the weight of the container 50 at full capacity.

The force of the movable section 23 pushing up the container 50 at the set position is preferably larger than the weight of the container 50 with the residual amount being at a predetermined value. The residual amount at a predetermined value can be set, for example, at a near end where the residual amount is in the range of 10% to 30% with respect to an end where the residual amount is zero. The near end is the residual amount that prompt a user to prepare a new container 50 before the residual amount of the container 50 becomes zero.

The container 50 includes a flexible bag 51 for storing liquid, and a box 52 that houses the bag 51. The box 52 is an opaque container such as a cardboard box that conceals the bag 51 inside. The bag 51 has an outlet 53 that is connected to the upstream end of the liquid flow path 22. The box 52 has a through port 54 for passing the liquid flow path 22 therethrough.

The outlet 53 is preferably disposed at a position closer to the bottom 52*a* than to the top 52*b* when the container 50 is at the set position. In addition, the position at which the movable section 23 pushes the container 50 is preferably spaced from the outlet 53. For example, when the container 50 is at the set position, the movable section 23 preferably pushes the position closer to a first end (left end in FIG. 3) than to the gravitational center position in the direction Y, and the outlet 53 is preferably disposed at the position closer to a second end (right end in FIG. 3) than to the gravitational center position.

Assuming that the weight of the container 50 at zero residual amount is defined as Ge, the weight of the container 50 at full capacity is defined as Gf, and the biasing force of the bias member 24 (the force of the movable section 23 pushing up the container 50) is defined as N, the biasing force N is smaller than Gf and larger than Ge. Further, assuming that the weight of the container 50 at the near end is defined as Gn, the biasing force N is larger than Gn ($Ge<Gn<N<Gf$).

Next, effects of the container 50, the liquid supplying apparatus 20, and the liquid ejecting apparatus 11 will be described. In preparation of supplying liquid stored in the container 50 to the liquid ejecting apparatus 11, the user connects the liquid flow path 22 to the outlet 53 of the container 50 and places the container 50 on the support table 21. In this state, when the supply pump 16 is driven, liquid stored in the container 50 flows out from the outlet 53 to the liquid flow path 22 and is supplied to the liquid ejection section 14 via the supplying tube 15. Accordingly, the liquid ejection section 14 can perform printing onto the medium 99.

Figure 4:
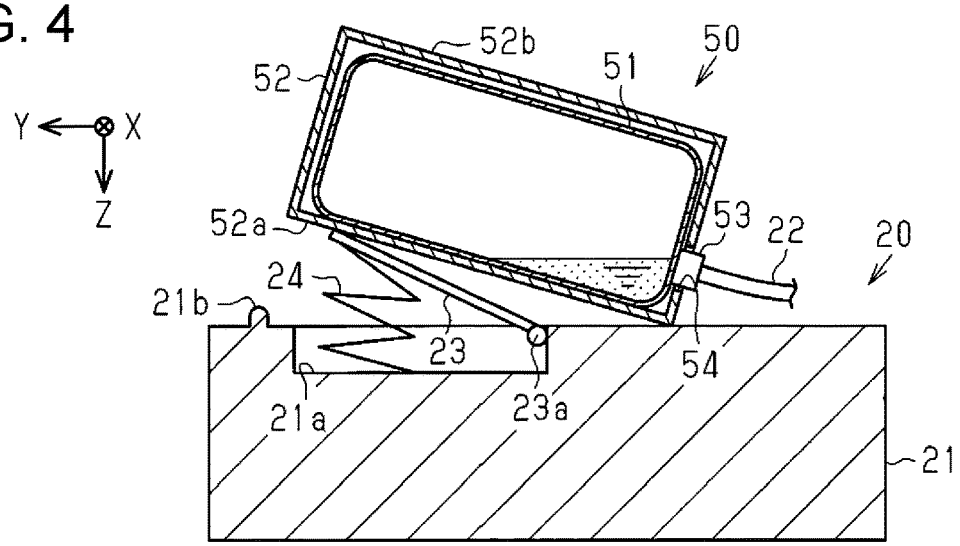
FIG. 4 is a cross-sectional view which illustrates an effect of the container and the liquid supplying apparatus of FIG. 1.

As the liquid ejection section 14 consumes the liquid, the residual amount of the container 50 decreases and the weight of the container 50 also decreases. As a result, when the biasing force of the bias member 24 becomes larger than the weight of the container 50, the first end of the container 50 is pushed up by the movable section 23 as shown in FIG. 4. FIG. 1 shows that the leftmost container 50 of four containers 50 arranged in the direction X is pushed up by the movable section 23 and the other three containers 50 are located at the set position.

Thus, as the residual amount decreases, the container 50 placed on the support table 21 is pushed up by the movable section 23 and displaced while remaining connected to the liquid flow path 22. As the container 50 is pushed up by the movable section 23 and tilted, the upper end of the container 50 moves vertically upward. Accordingly, the user can visually recognize a decrease in the residual amount of the container 50 with ease.

The residual amount of the container 50 can also be displayed on the operation panel 19. In this case, however, the residual amount of the container 50 cannot be visually observed until the user comes close to the operation panel 19. On the other hand, tilt of the container 50 can be visually observed at a position spaced from the container 50.

When the liquid cannot not be observed from outside such as the case of being stored in the container 50, the emptied container 50 is hardly distinguished by sight at the time of replacement of the container 50. Although the container 50 to be replaced can be displayed on the operation panel 19, there is a risk that the wrong container 50 is replaced if the support table 21 and the operation panel 19 are located at distant positions. In this regard, since the container 50 is displaced, the container 50 to be replaced can be easily distinguished by sight.

When the container 50 is at the set position and the movable section 23 pushes the container 50 at the position closer to the first end than to the gravitational center position, the container 50 is tilted about the second end as the pivot point with the first end upward. As a result, liquid in the bag 51 flows toward the outlet 53 located near the second end. Accordingly, liquid left in the bag 51 can efficiently flow out through the outlet 53.

According to the container 50, the liquid supplying apparatus 20, and the liquid ejecting apparatus 11 of the present embodiment, the following effects can be obtained.

(1) Since the flexible bag 51 is placed in the box 52 which is not easily deformed, handling such as carrying or stacking of the container 50 is facilitated.

(2) When the residual amount decreases and thus the weight of the container 50 decreases, the container 50 is pushed up by the movable section 23 and the upper end of the container 50 moves upward. This displacement of the container 50 allows for ease of visual recognition of a decrease of the liquid contained in the container 50.

(3) As the residual amount decreases, the tilt of the container 50 increases. Accordingly, as the tilt increases, the upper end of the container 50 moves further upward.

Accordingly, the user can estimate the approximate residual amount from the upper end position of the container 50.

(4) The container 50 can be pushed up by the biasing force of the bias member 24. In this case, since a power source is not required for displacement of the container 50, the liquid supplying apparatus 20 has a simplified configuration.

(5) When the movable section 23 tilts the container 50, the container 50 can be displaced by a force smaller than that used for lifting the entire container 50.

(6) As the first end of the container 50 moves upward by the tilt, liquid in the container 50 flows toward the second end. Accordingly, liquid stored in the container 50 can be used without waste.

(7) The liquid supplying apparatus 20 does not have to include a notification mechanism (for example, lamp, buzzer, display panel, or the like) that notifies a user of a decrease in the residual amount of the container 50. Accordingly, the liquid supplying apparatus 20 has a simplified configuration.

(8) The container 50 can be set on the support table 21 by simply placing it on the movable section 23 without precise positioning. Accordingly, the container 50 can be set with ease.

(9) Since the container 50 is just placed on the support table 21, it can be easily separated from the support table 21.

(10) The container 50 can be moved while being connected to the liquid flow path 22. As a result, positioning of the container 50 can be easily changed on the support table 21. Further, supply of liquid can be continued even if positioning of the container 50 is displaced.

The above embodiment may be changed as described in the following modified examples. The configurations included in the above embodiment can be combined with the configurations included in the following modified examples as appropriate. Further, each of the configurations included in the following modified examples may be combined as appropriate.

Figure 5:
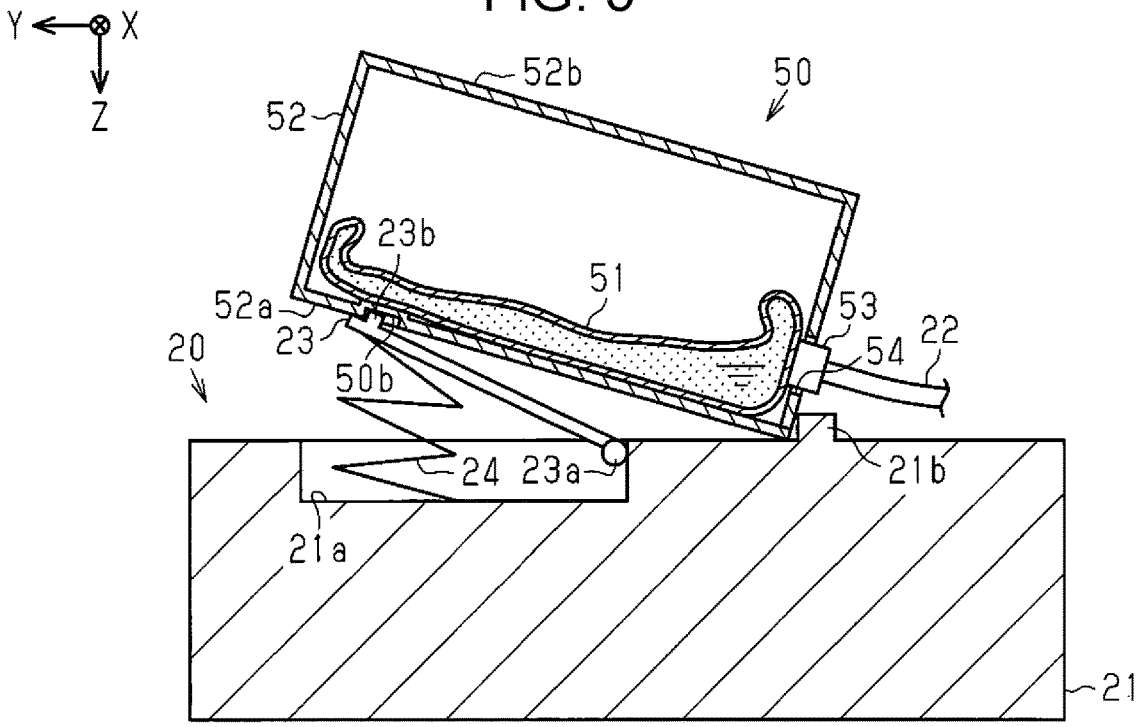
FIG. 5 is a cross-sectional view of a first modified example of the container and the liquid supplying apparatus.

According to the first modified example shown in FIG. 5, the movable section 23 may include an engagement section 23*b* that can engage the container 50. In this case, when the movable section 23 engages the container 50, the container 50 can be displaced while reducing positional deviation during tilting.

According to the first modified example shown in FIG. 5, the container 50 may include an engagement section 50*b* that can engage the container 23. With this configuration, when the container 50 engages the movable section 23, the container 50 can be displaced while reducing positional deviation of the container 50.

For example, one of the engagement section 23*b* and the engagement section 50*b* may be a protrusion and the other may be a recess. Alternatively, both of the engagement section 23*b* and the engagement section 50*b* may be protrusions. In addition, the container 50 may not necessarily include the engagement section 50*b*, and the engagement section 23*b* may engage a corner of the container 50. Alternatively, the movable section 23 may not necessarily include the engagement section 23*b*, and the engagement section 50*b* may engage an end of the movable section 23.

According to the first modified example shown in FIG. 5, the flexible bag 51 may contain deaerated liquid, and the bag 51 may be configured to collapse as the liquid flows out. Although FIGS. 2 to 4 show the liquid level for the purpose of explicitly indicating the residual amount of the container 50, the bag 51 of the above embodiment may also be configured to collapse as the liquid flows out as with the first modified example.

According to the first modified example shown in FIG. 5, the support table 21 may include the protrusion 21*b* that can lock the container the second end of the container 50, which serves as a pivot point during tilting. With this configuration, the tilting pivot of the container 50 is not easily deviated when pushed by the movable section 23. In this case, the container 50 may be put down from above the movable section 23 to be placed on the movable section 23.

Figure 6:
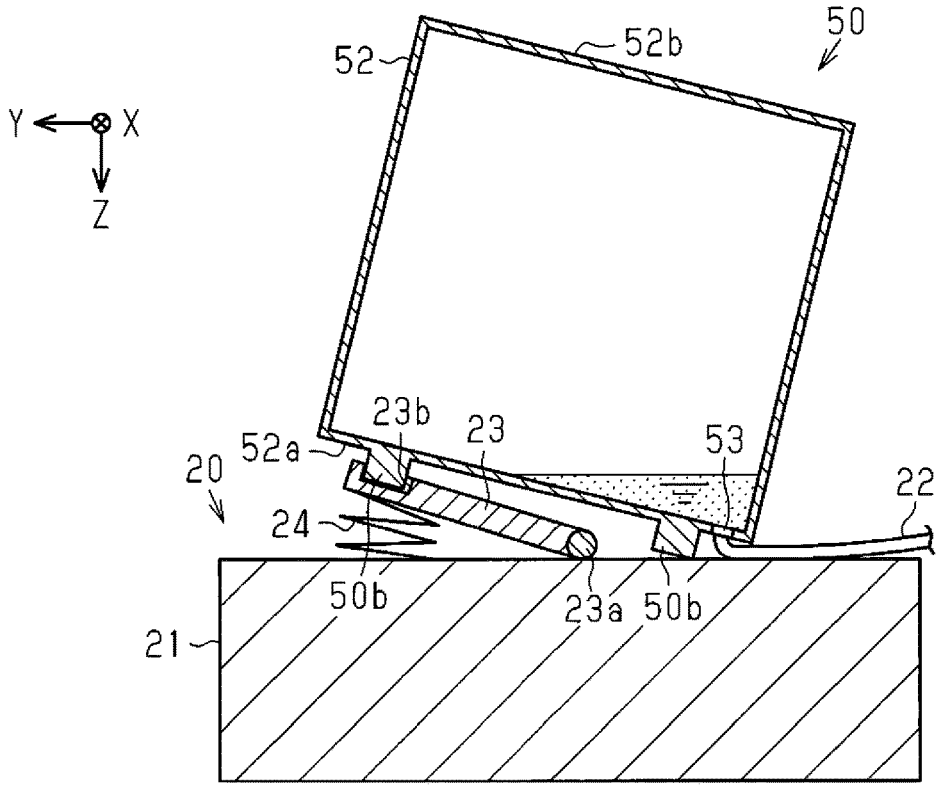
FIG. 6 is a cross-sectional view which illustrates a second modified example of the container and the liquid supplying apparatus.

According to the second modified example shown in FIG. 6, the engagement section 23*b* of the movable section 23 may be a recess.

According to the second modified example shown in FIG. 6, the engagement section 50*b* of the container 50 may be a protrusion.

According to the second modified example shown in FIG. 6, the container 50 may also include a plurality of engagement sections 50*b* that serve as support protrusions which extend from the bottom 52*a*. In this case, at least a portion of the movable section 23 and the bias member 24 may be housed in a gap formed between the bottom 52*a* and the support table 21 by the plurality of engagement sections 50*b*.

According to the second modified example shown in FIG. 6, the support table 21 may not necessarily include the recess 21*a*.

According to the second modified example shown in FIG. 6, when the gap is formed between the bottom 52*a* and the support table 21 by the plurality of engagement sections 50*b*, the outlet 53 may be provided on the bottom 52*a*.

According to the second modified example shown in FIG. 6, the container 50 may be a tank that can store liquid. Even if the container 50 is a transparent tank, the liquid level cannot be easily observed if the container 50 has damage such as a scratch or if liquid of a dark color is attached on the inner surface of the container 50. Accordingly, a decrease in the residual amount is preferably visually notified by displacement of the container 50.

According to the second modified example shown in FIG. 6, the volume of the container 50 may be increased by increasing the height of the container 50. When the plurality of containers 50 are placed on the support table 21, the containers 50 having different volumes can be set in the same manner by aligning the widths of the containers 50 (length in the direction X). Further, the liquid supplying apparatus 20 may be configured to tilt the containers 50 when the containers 50 having different volumes have the similar residual amount.

The configuration and shape of the container 50 can be changed. The liquid supplying apparatus 20 may be configured to displace the containers 50 in the similar manner when the containers 50 having different shapes. Further, the outlets 53 may have the common configuration so that the containers 50 having different shapes can be connected to the liquid flow path 22.

The movable section 23 may push up the entire container 50 upward.

The liquid supplying apparatus 20 may include a power source and a power transmission mechanism for pushing up the container 50 by the movable section 23. For example, the liquid supplying apparatus 20 may include a motor as a power source to rotate the pivot axis 23*a* by rotation of the motor, or may include a pump as a power source to move a piston as the movable section 23 by hydraulic pressure. Alternatively, the movable section 23 may be moved by power of a power source of the liquid ejecting apparatus 11.

The liquid supplying apparatus 20 may be part of the components of the liquid ejecting apparatus 11, or may be a separate device detachably attached to the liquid ejecting apparatus 11.

The container 50 may have a configuration in which liquid can be re-filled, or the bags 51 can be replaced into the box 52. Alternatively, the container 50 can be disposable.

Liquid ejected by the liquid ejection section 14 is not limited to ink, and may be, for example, a liquid material which is made by dispersing or mixing a particle of a functional material in liquid. For example, the liquid ejection section 14 may be configured to eject a liquid material which includes dispersed or mixed material such as electrode material or color material (pixel material) used for production of liquid crystal displays, EL (electroluminescence) displays and surface emission displays.

The medium 99 is not limited to a paper sheet, and may be a plastic film or a thin plate, or alternatively, a cloth used in a fabric printing apparatus. Further, the medium 99 may be an article of clothing in any shape such as a T-shirt, or a three-dimensional object such as an article of tableware or stationery in any shape.

Technical ideas achieved by the above embodiment and modified examples and their advantageous effects will be described below.

Idea 1

A liquid supplying apparatus including: a support table on which a container for storing liquid can be placed; a liquid flow path detachably connected to the container; and a movable section configured to push up the container placed on the support table, wherein a force of the movable section pushing up the container is smaller than a weight of the container at full capacity, and, as the residual amount of liquid decreases, the container placed on the support table is pushed up by the movable section and displaced while remaining connected to the liquid flow path.

With this configuration, when the stored liquid decreases and thus the weight of the container decreases, the container is pushed up by the movable section and the upper end of the container moves upward. This displacement of the container allows for ease of visual recognition of a decrease of the liquid contained in the contained.

Idea 2

The liquid supplying apparatus according to Idea 1, further comprising a bias member configured to bias the movable section upward.

With this configuration, the container can be pushed up by the biasing force of the bias member.

Idea 3

A liquid supplying apparatus including: a support table on which a container for storing liquid can be placed; a liquid flow path detachably connected to the container; a movable section configured to push up the container placed on the support table; and a bias member configured to bias the movable section upward, wherein the container placed on the support table is pushed up by the movable section and displaced depending on the amount of stored liquid while remaining connected to the liquid flow path.

With this configuration, the container is displaced depending on the amount of liquid stored. This displacement of the container allows for ease of visual recognition of a change in the amount of liquid stored in the container.

Idea 4

The liquid supplying apparatus according to any one of Ideas 1 to 3, wherein the container has a bottom that is in contact with the movable section when the container is placed on the support table, and the movable section is configured to push the bottom at a position spaced from a gravitational center position, which is a position at which the gravitational center of the container is projected onto the bottom.

With this configuration, as the movable section pushes the container, the container is tilted. Accordingly, the container can be displaced by a force smaller than that used for lifting the entire container.

Idea 5

The liquid supplying apparatus according to any one of Ideas 1 to 4, wherein the movable section includes an engagement section configured to engage the container.

With this configuration, when the movable section engages the container, the container can be displaced while reducing positional deviation of the container.

Idea 6

A container for storing liquid that can be placed on the support table provided in the liquid ejecting apparatus according to any one of Ideas 1 to 5, the container comprising an engagement section configured to engage the movable section.

With this configuration, when the container engages the movable section, positional deviation of the container can be reduced when the container is displaced.

Idea 7

A liquid ejecting apparatus including: a liquid ejection section configured to eject liquid onto a medium; a support table on which a container for storing liquid can be placed; a liquid flow path detachably connected to the container; and a movable section configured to push up the container placed on the support table, wherein a force of the movable section pushing up the container is smaller than a weight of the container at full capacity, and, as the residual amount of liquid decreases, the container placed on the support table is pushed up by the movable section and displaced while remaining connected to the liquid flow path.

With this configuration, the advantageous effect similar to that of the above liquid supplying apparatus can be obtained.

This application claims priority under 35 U.S.C. § 119 to Japanese Patent Application No. 2017-059259, filed Mar. 24, 2017. The entire disclosure of Japanese Patent Application No. 2017-059259 is hereby incorporated herein by reference.

What is claimed is:

1. A liquid ejecting apparatus comprising:

a support table on which a container for storing liquid can be placed;

a liquid flow path detachably connected to the container, the liquid flow path being connected to a pump that is configured to cause the liquid to be removed from the container; and a movable section configured to push up the container placed on the support table, wherein the moveable section is configured to cause the container to be oriented in a horizontal direction until such time as the moveable section pushes up the container, the movable section comprising an engagement section configured to cooperate with a complementary engagement section of the container that is disposed between a first end and a second end of the container and facing toward the movable section; and a bias member configured to bias the moveable section upward, both terminal ends of the bias member being disposed lower than a lowest portion of the container in a vertical direction transverse to the horizontal direction with the container mounted to the support table in a set position, wherein a force of the movable section pushing up the container is smaller than a weight of the container at full capacity, and, as the amount of liquid decreases, the container placed on the support table is pushed up by the movable section and displaced while remaining connected to the liquid flow path.

2. The liquid ejecting apparatus according to claim 1, wherein the container has a bottom that is in contact with the movable section when the container is placed on the support table, and the movable section is configured to push the bottom at a position spaced from a gravitational center position, which is a position at which the gravitational center of the container is projected onto the bottom.

3. A container for storing liquid that can be placed on the support table provided in the liquid ejecting apparatus according to claim 2, wherein the engagement section is configured to engage the movable section.

4. A container for storing liquid that can be placed on the support table provided in the liquid ejecting apparatus according to claim 1, wherein the engagement section is configured to engage the movable section.

5. A liquid ejecting apparatus comprising:

a support table on which a container for storing liquid can be placed;

a liquid flow path detachably connected to the container, the liquid flow path being connected to a pump that is configured to cause the liquid to be removed from the container;

a movable section configured to push up the container placed on the support table, wherein the moveable section is configured to cause the container to be oriented in a horizontal direction until such time as the moveable section pushes up the container, the movable section comprising an engagement section configured to cooperate with a complementary engagement section of the container that is disposed between a first end and a second end of the container and facing toward the movable section; and a bias member configured to bias the movable section upward, both terminal ends of the bias member being disposed lower than a lowest portion of the container in a vertical direction transverse to the horizontal direction with the container mounted to the support table in a set position, wherein the container placed on the support table is pushed up by the movable section and displaced depending on the amount of stored liquid while remaining connected to the liquid flow path.

6. A container for storing liquid that can be placed on the support table provided in the liquid ejecting apparatus according to claim 5, wherein the engagement section is configured to engage the movable section.

7. A liquid ejecting apparatus comprising:

a liquid ejection section configured to eject liquid onto a medium;

a support table on which a container for storing liquid can be placed;

a liquid flow path detachably connected to the container, the liquid flow path being connected to a pump that is configured to cause the liquid to be removed from the container; and a movable section configured to push up the container placed on the support table, wherein the moveable section is configured to cause the container to be oriented in a horizontal direction until such time as the moveable section pushes up the container, the movable section comprising an engagement section configured to cooperate with a complementary engagement section of the container that is disposed between a first end and a second end of the container and facing toward the movable section; and a bias member configured to bias the moveable section upward, both terminal ends of the bias member being disposed lower than a lowest portion of the container in a vertical direction transverse to the horizontal direction with the container mounted to the support table in a set position, wherein a force of the movable section pushing up the container is smaller than a weight of the container at full capacity, and, as the amount of liquid decreases, the container placed on the support table is pushed up by the movable section and displaced while remaining connected to the liquid flow path.

* * * * *